US010472934B2

(12) United States Patent
Marshall et al.

(10) Patent No.: US 10,472,934 B2
(45) Date of Patent: Nov. 12, 2019

(54) DOWNHOLE TRANSDUCER ASSEMBLY

(71) Applicant: Novatek IP, LLC, Provo, UT (US)

(72) Inventors: Jonathan Marshall, Mapleton, UT (US); Scott Dahlgren, Alpine, UT (US)

(73) Assignee: NOVATEK IP, LLC, Provo, UT (US)

( * ) Notice: Subject to any disclaimer, the term of this patent is extended or adjusted under 35 U.S.C. 154(b) by 154 days.

(21) Appl. No.: 15/590,882

(22) Filed: May 9, 2017

(65) Prior Publication Data

US 2017/0241242 A1 Aug. 24, 2017

Related U.S. Application Data

(63) Continuation-in-part of application No. 15/152,189, filed on May 11, 2016, now Pat. No. 10,113,399.

(60) Provisional application No. 62/164,933, filed on May 21, 2015.

(51) Int. Cl.

| | |
|---|---|
| ***E21B 41/00*** | (2006.01) |
| ***F01D 15/10*** | (2006.01) |
| ***F03B 1/02*** | (2006.01) |
| ***F01C 1/34*** | (2006.01) |
| ***F01D 5/06*** | (2006.01) |

(52) U.S. Cl.

CPC ..... *E21B 41/0085* (2013.01); *F01C 1/34* (2013.01); *F01D 5/06* (2013.01); *F01D 15/10* (2013.01); *F03B 1/02* (2013.01); *F05B 2220/20* (2013.01); *F05D 2220/20* (2013.01)

(58) Field of Classification Search

CPC ..... E21B 41/0085; F01D 5/06; F01D 15/10; F01C 1/34; F03B 1/02; F05D 2220/20; F05B 2220/20

See application file for complete search history.

(56) References Cited

U.S. PATENT DOCUMENTS

| | | | |
|---|---|---|---|
| 2,266,355 | A | 12/1941 | Chun et al. |
| 4,132,269 | A | 1/1979 | Chasteen |
| 4,155,022 | A | 5/1979 | Crockett |
| 4,491,738 | A | 1/1985 | Kamp |
| 4,532,614 | A | 7/1985 | Peppers |
| 4,628,995 | A | 12/1986 | Young et al. |
| 4,671,735 | A | 6/1987 | Rossmann et al. |
| 5,248,896 | A | 9/1993 | Forrest |
| 5,265,682 | A | 11/1993 | Russell |
| 5,285,204 | A | 2/1994 | Sas-Jaworsky |
| 5,517,464 | A | 5/1996 | Lerner et al. |
| 5,803,185 | A | 9/1998 | Barr |

(Continued)

OTHER PUBLICATIONS

Office Action Issued in U.S. Appl. No. 15/352,620 dated Dec. 27, 2017. 10 pages.

(Continued)

*Primary Examiner* — Brad Harcourt

(57) ABSTRACT

A downhole drill pipe may comprise a transducer disposed therein, capable of converting energy from flowing fluid into electrical energy. A portion of a fluid flowing through the drill pipe may be diverted to the transducer. After passing the transducer, the diverted portion of the fluid may be discharged to an exterior of the drill pipe. To generate electrical energy while not obstructing the main fluid flow from passing through the drill pipe, the transducer may be disposed within a lateral sidewall of the drill pipe with an outlet for discharging fluid exposed on an exterior of the lateral sidewall.

20 Claims, 8 Drawing Sheets

(56) References Cited

U.S. PATENT DOCUMENTS

| | | | | |
|---|---|---|---|---|
| 5,839,508 | A | 11/1998 | Tubel et al. | |
| 6,089,332 | A | 7/2000 | Barr | |
| 6,386,302 | B1 | 5/2002 | Beaton | |
| 6,554,074 | B2 | 4/2003 | Longbottom | |
| 6,607,030 | B2 | 8/2003 | Bauer et al. | |
| 6,672,409 | B1 | 1/2004 | Dock et al. | |
| 6,717,283 | B2 | 4/2004 | Skinner et al. | |
| 6,848,503 | B2 | 2/2005 | Schultz et al. | |
| 6,851,481 | B2 | 2/2005 | Vinegar et al. | |
| 7,002,261 | B2 | 2/2006 | Cousins | |
| 7,133,325 | B2 | 11/2006 | Kotsonis et al. | |
| 7,137,463 | B2 | 11/2006 | Beaton | |
| 7,190,084 | B2 | 3/2007 | Hall et al. | |
| 7,293,617 | B2 | 11/2007 | Beaton | |
| 7,348,893 | B2 | 3/2008 | Huang et al. | |
| 7,434,634 | B1 | 10/2008 | Hall et al. | |
| 7,451,835 | B1 | 11/2008 | Hall et al. | |
| 7,484,576 | B2 | 2/2009 | Hall et al. | |
| 7,537,051 | B1 | 5/2009 | Hall et al. | |
| 7,650,952 | B2 | 1/2010 | Evans et al. | |
| 7,814,993 | B2 | 10/2010 | White | |
| 8,033,328 | B2 | 10/2011 | Hall et al. | |
| 8,092,147 | B2 | 1/2012 | Draeger et al. | |
| 8,297,375 | B2 | 10/2012 | Hall et al. | |
| 8,297,378 | B2 | 10/2012 | Hall et al. | |
| 8,366,400 | B2 | 2/2013 | Ochiai et al. | |
| 8,596,368 | B2 | 12/2013 | Frosell | |
| 8,656,589 | B2 | 2/2014 | Kurt-Elli | |
| 8,792,304 | B2 | 7/2014 | Sugiura | |
| 8,957,538 | B2 | 2/2015 | Inman | |
| 9,013,957 | B2 | 4/2015 | Vecseri et al. | |
| 9,035,788 | B2 | 5/2015 | Downton et al. | |
| 9,038,735 | B2 | 5/2015 | Segura et al. | |
| 9,046,080 | B2 | 6/2015 | Sliwa | |
| 9,309,748 | B2 | 4/2016 | Gadot et al. | |
| 9,312,557 | B2 | 4/2016 | Zhang et al. | |
| 9,356,497 | B2 | 5/2016 | Chambers | |
| 9,534,577 | B2 | 1/2017 | Inman et al. | |
| 9,546,539 | B2 | 1/2017 | Hudson et al. | |
| 9,598,937 | B2 | 3/2017 | Chen et al. | |
| 10,113,399 | B2 * | 10/2018 | Hall | E21B 41/0085 |
| 2002/0125047 | A1 | 9/2002 | Beaton | |
| 2002/0162654 | A1 | 11/2002 | Bauer et al. | |
| 2003/0116969 | A1 | 6/2003 | Skinner et al. | |
| 2004/0206552 | A1 | 10/2004 | Beaton | |
| 2005/0012340 | A1 | 1/2005 | Cousins | |
| 2005/0139393 | A1 | 6/2005 | Maurer et al. | |
| 2006/0016606 | A1 | 1/2006 | Tubel et al. | |
| 2006/0100968 | A1 | 5/2006 | Hall et al. | |
| 2006/0175838 | A1 | 8/2006 | Tips | |
| 2007/0029115 | A1 | 2/2007 | Beaton | |
| 2007/0175032 | A1 | 8/2007 | Kurt-Elli | |
| 2007/0194948 | A1 | 8/2007 | Hall et al. | |
| 2007/0272410 | A1 | 11/2007 | Hromas et al. | |
| 2008/0047753 | A1 | 2/2008 | Hall et al. | |
| 2008/0047754 | A1 | 2/2008 | Evans et al. | |
| 2008/0226460 | A1 | 9/2008 | Ochiai et al. | |
| 2008/0284174 | A1 | 11/2008 | Nagler | |
| 2008/0298962 | A1 | 12/2008 | Sliwa | |
| 2010/0000793 | A1 * | 1/2010 | White | E21B 41/0085 175/57 |
| 2010/0065334 | A1 | 3/2010 | Hall et al. | |
| 2011/0273147 | A1 | 11/2011 | Hall et al. | |
| 2011/0280105 | A1 | 11/2011 | Hall et al. | |
| 2012/0139250 | A1 * | 6/2012 | Inman | E21B 21/10 290/52 |
| 2014/0014413 | A1 | 1/2014 | Niina et al. | |
| 2014/0174733 | A1 | 6/2014 | Gadot et al. | |
| 2015/0107244 | A1 | 4/2015 | Lakic | |
| 2015/0194860 | A1 | 7/2015 | Caliz et al. | |
| 2016/0017693 | A1 | 1/2016 | Winslow et al. | |
| 2016/0265315 | A1 | 9/2016 | Frosell et al. | |
| 2016/0341012 | A1 | 11/2016 | Riley et al. | |

OTHER PUBLICATIONS

Office Action Issued in U.S. Appl. No. 15/152,189 dated Jan. 18, 2018. 7 pages.

International Search Report and Written Opinion issued in International Patent Application PCT/US2016/062116, dated Sep. 26, 2017. 25 pages.

Office Action Issued in U.S. Appl. No. 15/352,620 dated May 14, 2018. 10 pages.

Office Action Issued in U.S. Appl. No. 15/352,620 dated Sep. 24, 2018. 10 pages.

* cited by examiner

DOWNHOLE TRANSDUCER ASSEMBLY

CROSS REFERENCE TO RELATED APPLICATIONS

This patent application is a continuation-in-part of U.S. patent application Ser. No. 15/152,189 entitled "Downhole Turbine Assembly" and filed May 11, 2016 which claims priority to U.S. Prov. App. No. 62/164,933 entitled "Downhole Power Generator" and filed May 21, 2015; both of which are incorporated herein by reference for all that they contain.

BACKGROUND

When exploring for or extracting subterranean resources such as oil, gas, or geothermal energy, and in similar endeavors, it is common to form boreholes in the earth. To form such a borehole 111, an embodiment of which is shown in FIG. 1, a specialized drill bit 112 may be suspended from a derrick 113 by a drill string 114. This drill string 114 may be formed from a plurality of drill pipe sections 115 fastened together end-to-end. As the drill bit 112 is rotated, either at the derrick 113 or by a downhole motor, it may engage and degrade a subterranean formation 116 to form the borehole 111 therethrough. Drilling fluid may be passed along the drill string 114, through each of the drill pipe sections 115, and expelled at the drill bit 112 to cool and lubricate the drill bit 112 as well as carry loose debris to a surface of the borehole 111 through an annulus surrounding the drill string 114.

Various electronic devices, such as sensors, receivers, communicators or other tools, may be disposed along a drill string or at a drill bit. To power such devices, it is known to generate electrical power downhole by converting energy from flowing drilling fluid by means of a generator. One example of such a downhole generator is described in U.S. Pat. No. 8,957,538 to Inman et al. as comprising a turbine located on the axis of a drill pipe, which has outwardly projecting rotor vanes, mounted on a mud-lubricated bearing system to extract energy from the flow. The turbine transmits its mechanical energy via a central shaft to an on-axis electrical generator which houses magnets and coils.

One limitation of this on-axis arrangement, as identified by Inman, is the difficultly of passing devices through the drill string past the generator. Passing devices through the drill string may be desirable when performing surveys, maintenance or fishing operations. To address this problem, Inman provides a detachable section that can be retrieved from the downhole drilling environment to leave an axially-located through bore without removing the entire drill string.

It may be typical in downhole applications employing a turbine similar to the one shown by Inman to pass around 800 gallons/minute (3.028 $m^3$/min) of drilling fluid there past. As the drilling fluid rotates the turbine, it may experience a pressure drop of approximately 5 pounds/square inch (34.47 kPa). Requiring such a large amount of drilling fluid to rotate a downhole turbine may limit a drilling operator's ability to control other drilling operations that may also require a certain amount of drilling fluid.

A need therefore exists for a means of generating electrical energy downhole that requires less fluid flow to operate. An additional need exists for an electrical energy generating device that does not require retrieving a detachable section in order to pass devices through a drill string.

BRIEF DESCRIPTION

A downhole drill pipe may comprise a transducer assembly housed within a lateral sidewall thereof, capable of converting energy from flowing drilling fluid into electrical energy. A portion of a drilling fluid flowing through the drill pipe may be diverted to the transducer assembly and then discharged to an exterior of the drill pipe.

As fluid pressure within the drill pipe may be substantially greater than outside thereof, similar amounts of electricity may be produced as previously possible while using significantly less drilling fluid. For example, while previous technologies may have had around 800 gallons/minute (3.028 $m^3$/min) of drilling fluid experience a pressure drop of around 5 pounds/square inch (34.47 kPa), embodiments of transducer assemblies described herein may divert around 1-10 gallons/minute (0.003785-0.03785 $m^3$/min) of drilling fluid to an annulus surrounding a drill pipe to experience a pressure drop of around 500-1000 pounds/square inch (3,447-6,895 kPa) to produce similar electricity.

In various embodiments, the transducer assembly may comprise a positive displacement motor, such as a progressive cavity motor or rotary vane motor, a Pelton wheel, or one or more turbines.

DRAWINGS

FIG. 4-1 is a partially cutaway, orthogonal view of another embodiment of a downhole transducer assembly comprising a positive displacement motor, this time, in the form of a rotary vane motor. FIG. 4-2 shows a cross-sectional view of the embodiment of the rotary vane motor.

FIG. 5-1 is a partially cutaway, orthogonal view of an embodiment of a downhole transducer assembly comprising a Pelton wheel. FIG. 5-2 shows a cross-sectional view of the embodiment of the Pelton wheel.

Figure 1:
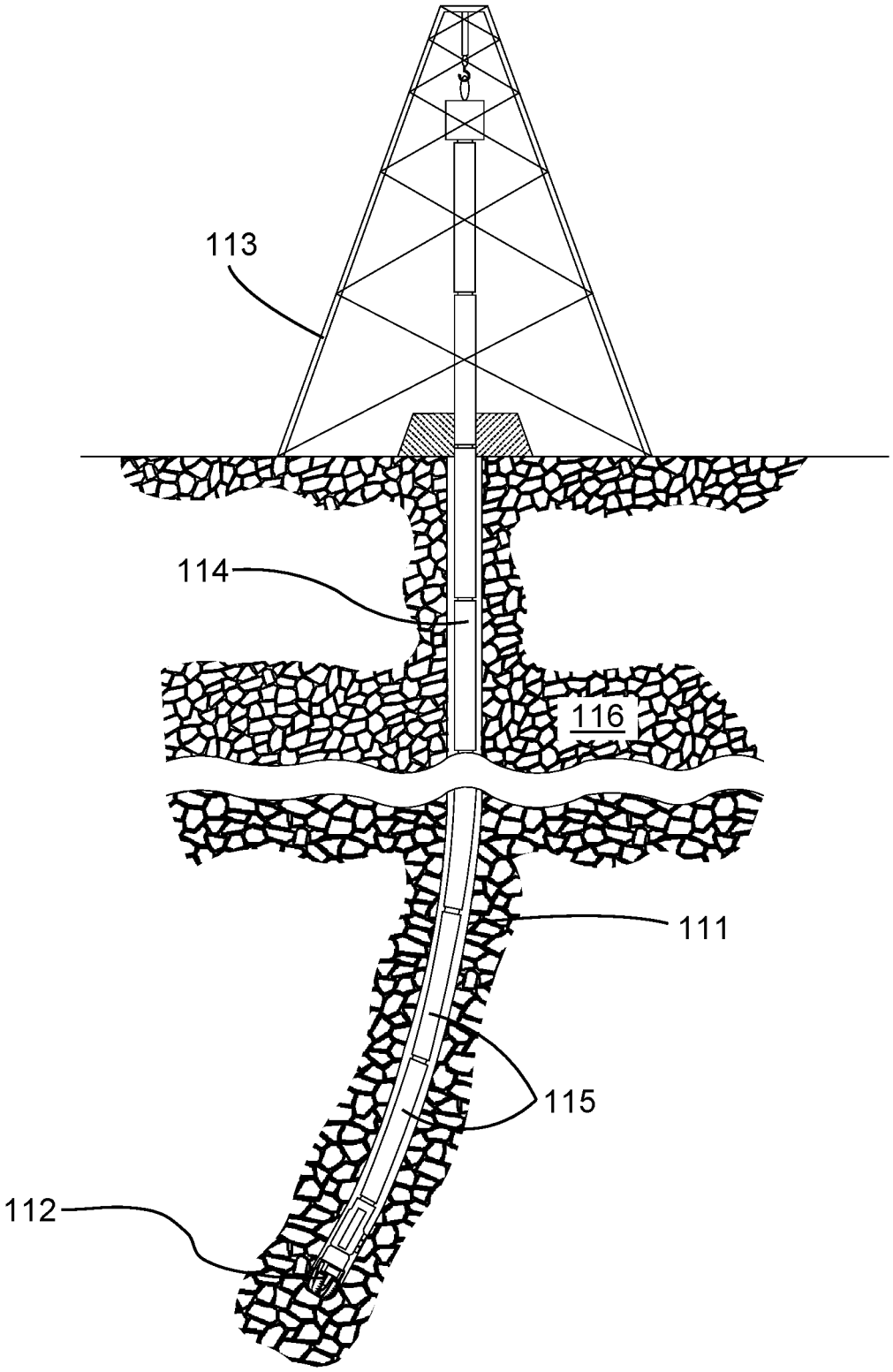
FIG. 1 is an orthogonal view of an embodiment of a drilling operation comprising a drill bit secured to an end of a drill string suspended from a derrick.
Figure 2:
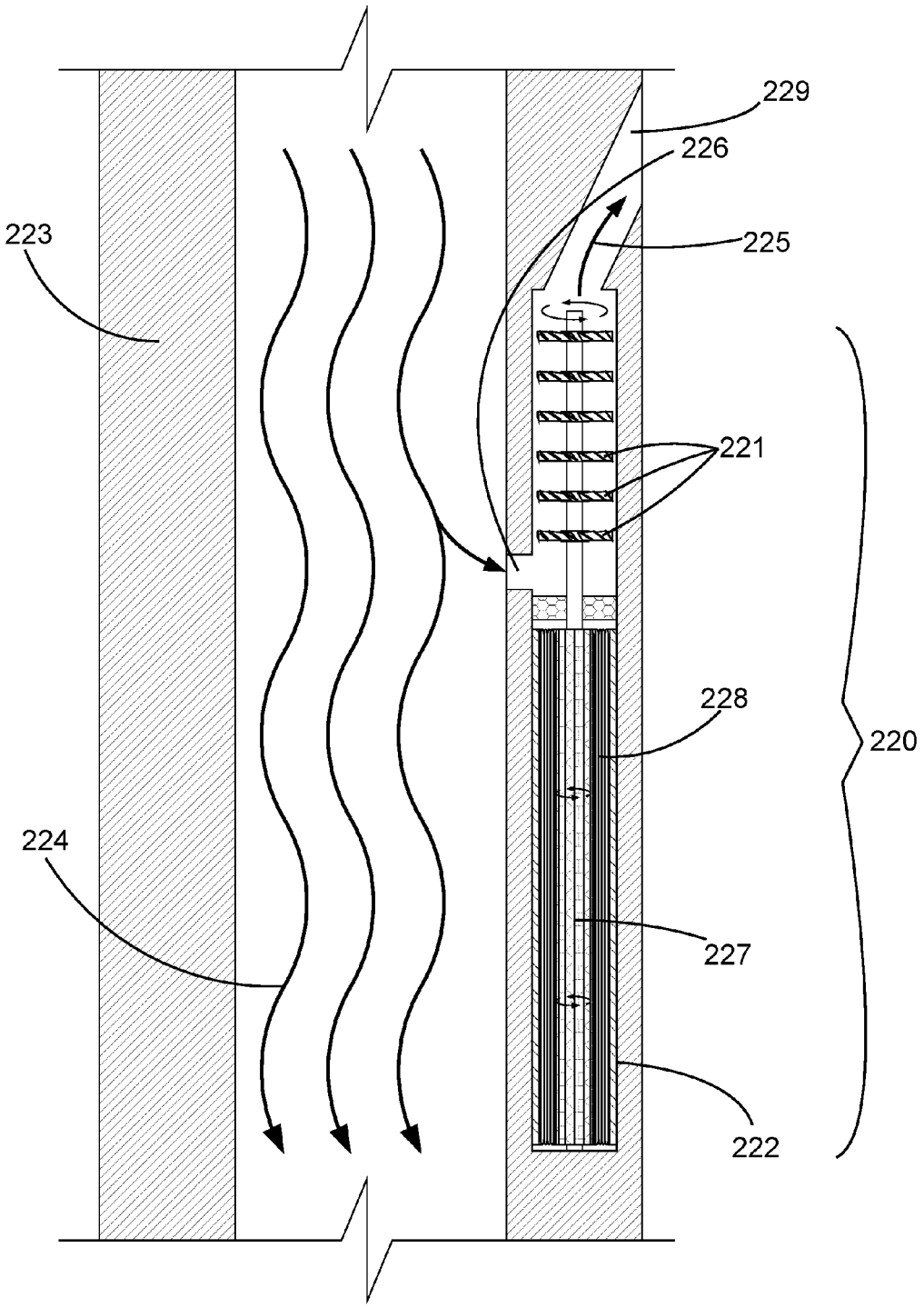
FIG. 2 is a partially cutaway, orthogonal view of an embodiment of a downhole transducer assembly, comprising a series of turbines, housed within a lateral sidewall of a section of drill pipe.
Figure 3:
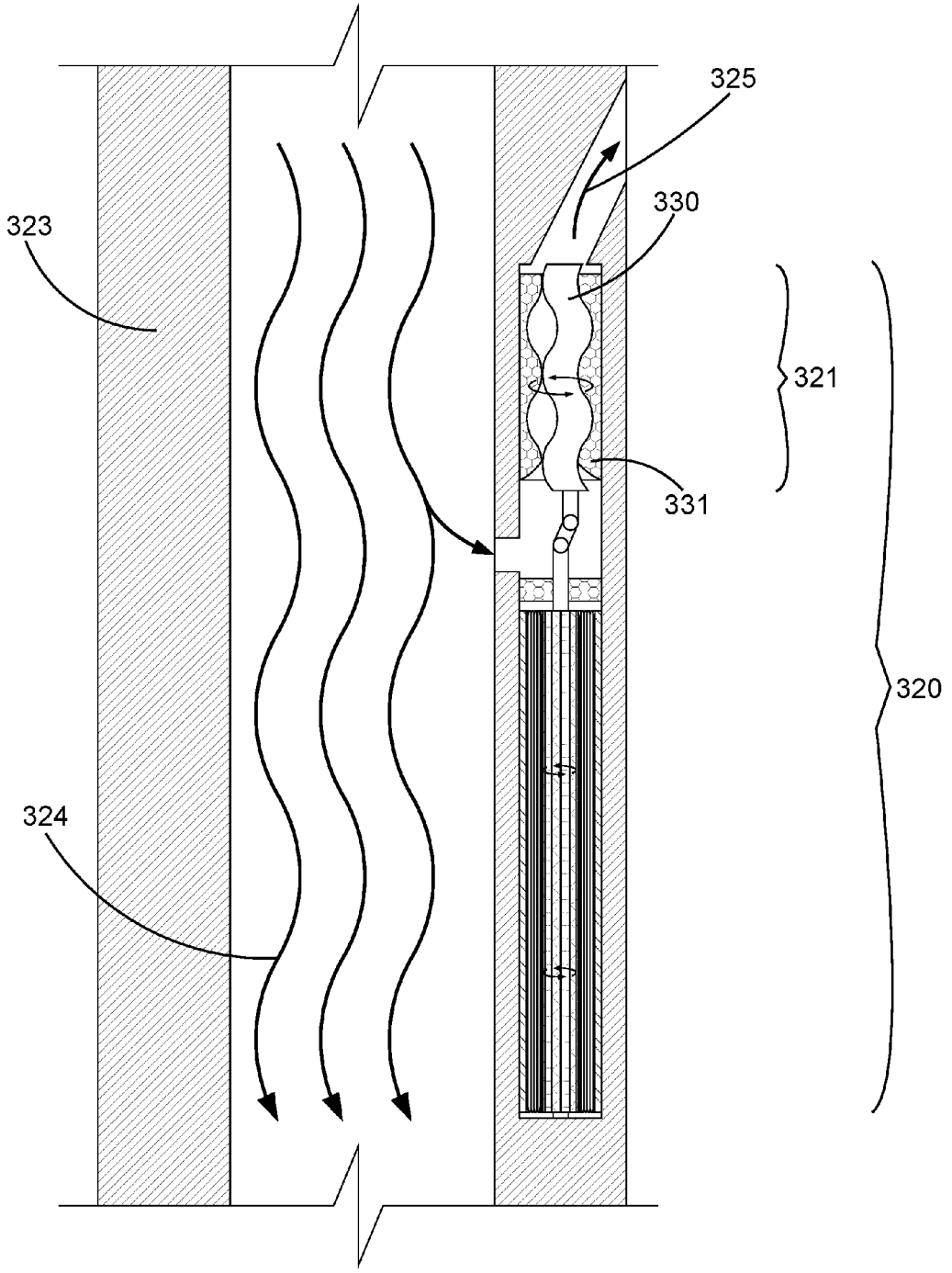
FIG. 3 is a partially cutaway, orthogonal view of an embodiment of a downhole transducer assembly comprising a positive displacement motor in the form of a progressive cavity motor.
Figures 2, 7:
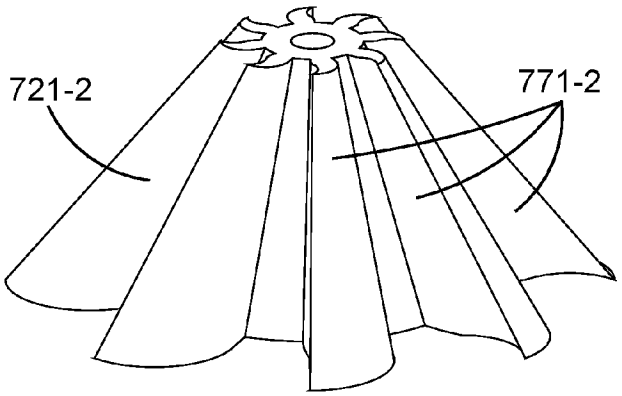
Figures 3, 7:
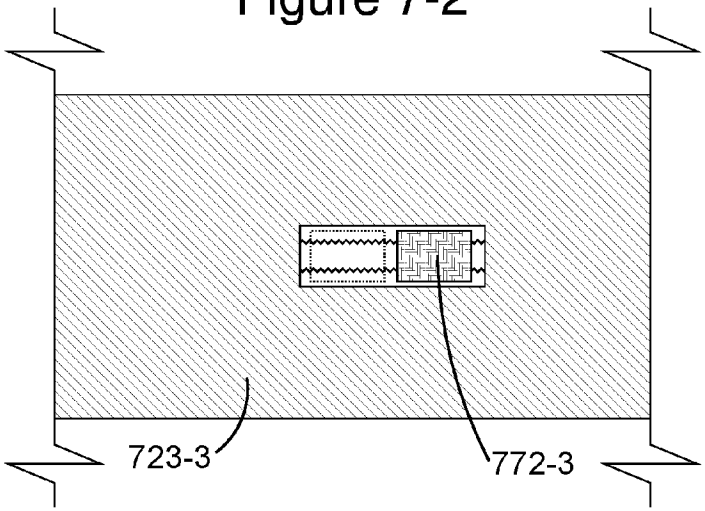
Figures 1, 7:
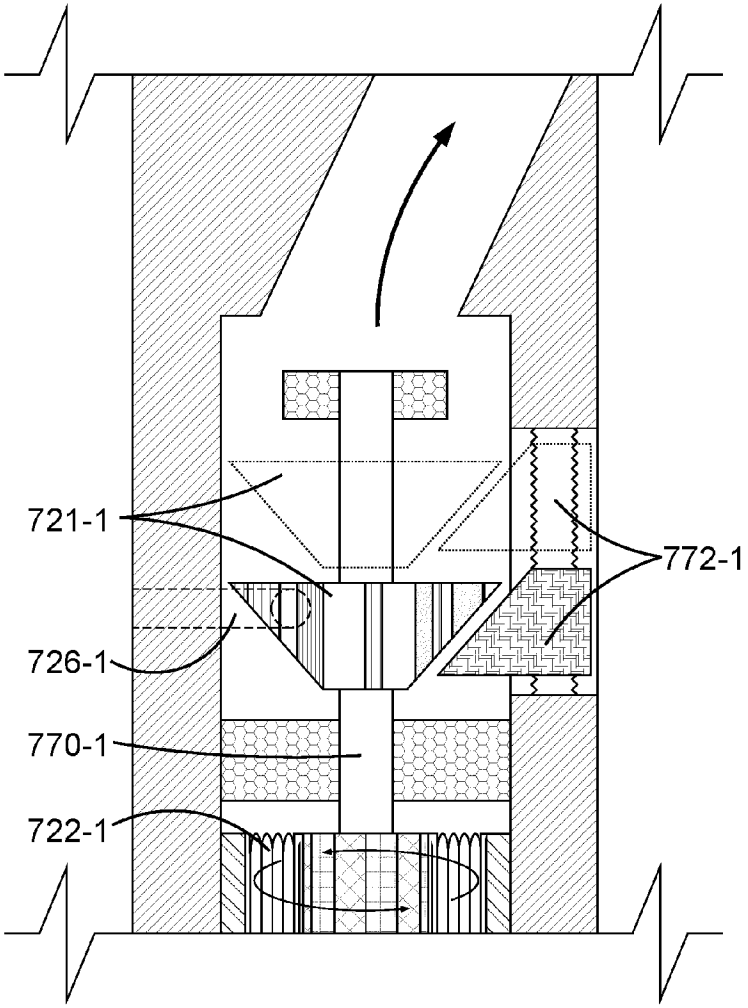

FIG. 7-1 is a partially cutaway, orthogonal view of an embodiment of a downhole transducer assembly comprising an axially-slidable turbine. FIG. 7-2 is a perspective view of a turbine comprising angled blades. FIG. 7-3 is an orthogonal view of a drill pipe comprising an adjustment mechanism accessible from an exterior thereof.

Figures 2, 8:
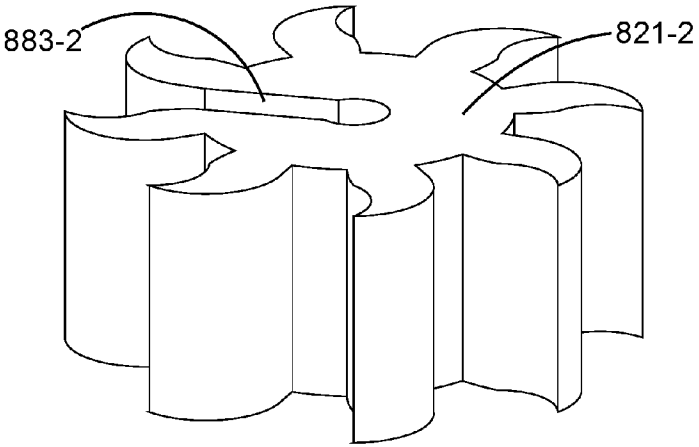
Figures 3, 8:
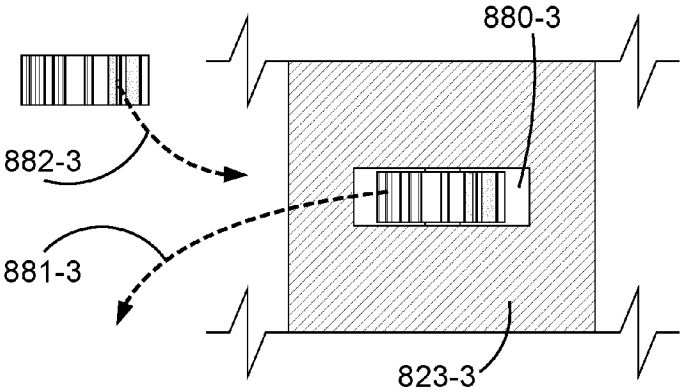
Figures 1, 8:
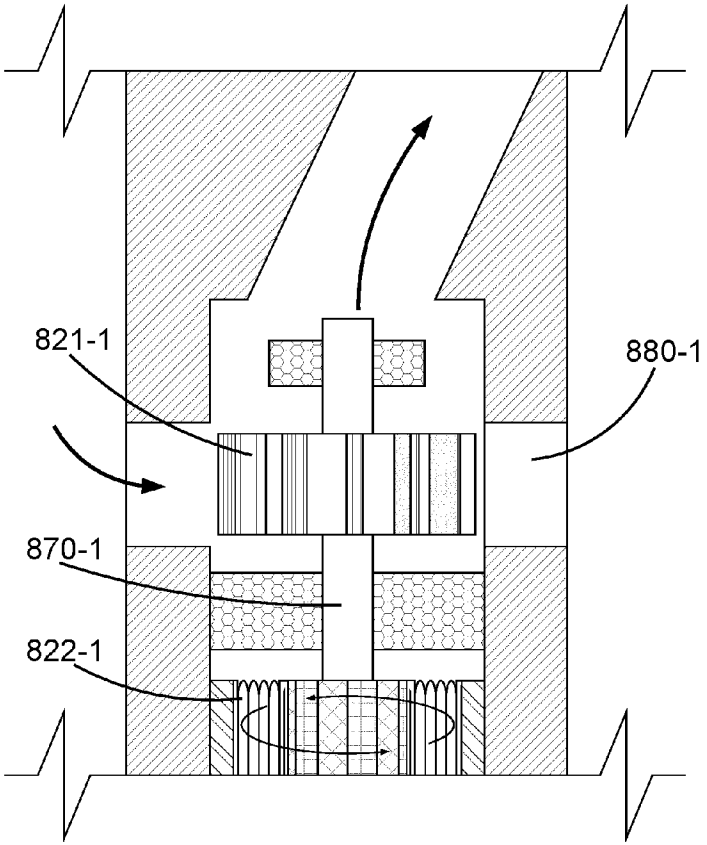

FIG. 8-1 is a partially cutaway, orthogonal view of an embodiment of a downhole transducer assembly comprising a replaceable turbine. FIG. 8-2 is a perspective view of a turbine comprising a slot disposed therein. FIG. 8-3 is an orthogonal view of a drill pipe comprising a slot disposed in an exterior thereof allowing for replacement of a turbine.

DETAILED DESCRIPTION

FIG. 2 shows one embodiment of a downhole transducer assembly 220, comprising a series of turbines 221 attached to a generator 222, housed within a lateral sidewall of a section of drill pipe 223. In this position, a primary flow 224 of drilling fluid may travel along the drill pipe 223 generally unobstructed by the transducer assembly 220. A portion of this primary flow 224 of drilling fluid may be diverted to create a diverted flow 225 that may be drawn into a course 226 leading to the series of turbines 221.

The diverted flow 225 may impact each of the turbines 221 causing them to rotate. Rotation of the turbines 221 may be transmitted to a rotor 227 of the generator 222 comprising a plurality of magnets of alternating polarity disposed thereon. Rotation of the magnets may induce electrical current in coils of wire wound around poles of a stator 228. By so doing, the transducer assembly 220 may convert energy from the diverted flow 225 into electrical energy that may be used by any of a number of downhole tools. Those of skill in the art will recognize that, in various embodiments, a plurality of magnets, either permanent magnets or electromagnets, and coils of wire may be disposed opposite each other on either a rotor or a stator to produce a similar result.

After rotating the series of turbines 221, the diverted flow 225 may be discharged to an annulus surrounding the drill pipe 223 through an outlet 229 exposed on an exterior thereof. In the embodiment shown, the diverted flow 225 comprises 1-10 gallons/minute (0.003785-0.03785 $m^3$/min) and experiences a pressure drop of 500-1000 pounds/square inch (3,447-6,895 kPa) as it passes the turbines 221.

FIG. 3 shows another embodiment of a downhole transducer assembly 320. In this embodiment, the downhole transducer assembly 320 comprises a positive displacement motor 321 rather than turbines. The positive displacement motor 321 may take the form of a progressive cavity motor comprising a rotor 330, with a helically shaped exterior, eccentrically rotatable within a stator 331, having a likewise helically shaped interior, wherein the helix of the stator 331 comprises more lobes than the helix of the rotor 330.

Similar to the previously discussed embodiment, the downhole transducer assembly 320 comprising the progressive cavity motor may be housed within a lateral sidewall of a section of a drill pipe 323 so as not to obstruct a primary flow 324 of drilling fluid traveling therein. The progressive cavity motor may also be powered by a diverted flow 325 of drilling fluid that may be discharged to an annulus surrounding the drill pipe 323.

Unique manufacturing techniques may be required to form a progressive cavity motor, rotor and stator, of sufficient compactness to fit within a lateral sidewall of a drill pipe as shown. Traditional progressive cavity motor designs typically comprise a steel rotor coated with a hard surface, such as chromium, and a molded elastomer stator secured inside a metal tube housing. At smaller sizes, however, even small amounts of wear on the rotor may become unacceptable and elastomers thin enough to fit may peel away from their tubular housings. Thus, the present embodiment comprises diamond disposed on an exterior of the rotor 330 thereof. This diamond may be deposited on a steel rotor by chemical vapor deposition or other processes. Alternatively, an entire rotor may be formed of polycrystalline diamond in a high-pressure, high-temperature pressing operation. Additionally, it is believed that an elastic interior stator surface may not be necessary when diamond is used.

Figures 1, 4:
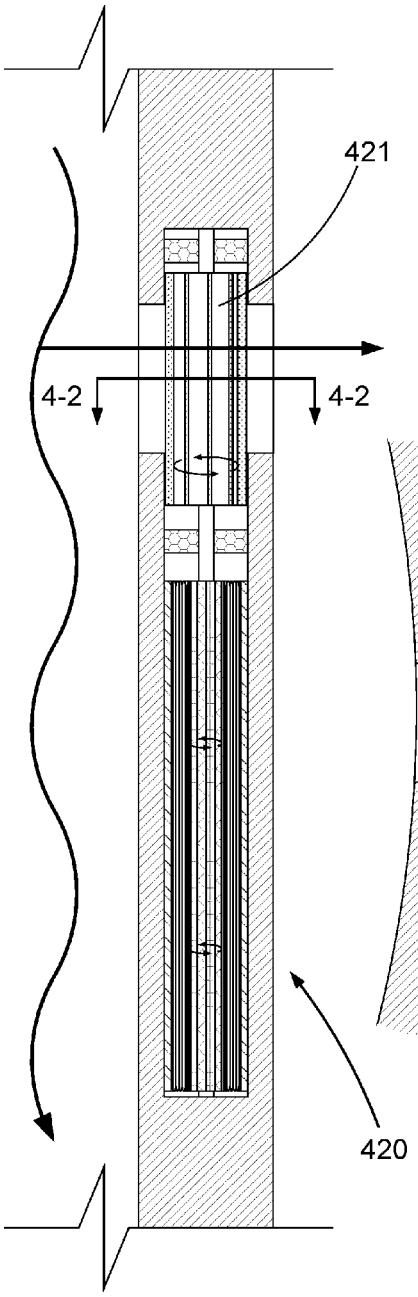
Figures 2, 4:
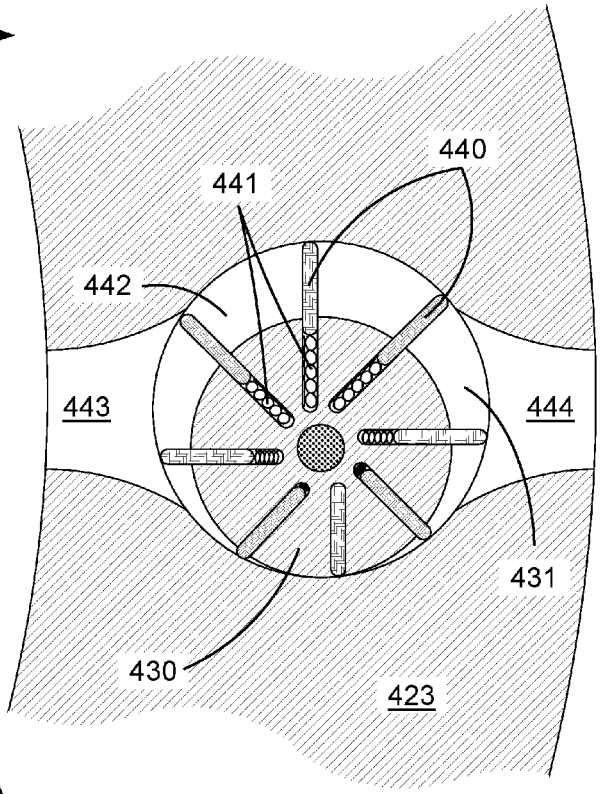

FIG. 4-1 shows another embodiment of a downhole transducer assembly 420 comprising a positive displacement motor 421. In this embodiment the positive displacement motor 421 takes the form of a rotary vane motor. The rotary vane motor, as also shown in FIG. 4-2, comprises a plurality of vanes 440 mounted to a rotor 430 that may rotate inside a cavity 431 disposed within a lateral sidewall of a drill pipe 423. A rotational center of the rotor 430 may be offset from a center of the cavity 431. Each of the plurality of vanes 440 may be pressed by one of a plurality of springs 441 against an inner wall of the cavity 431 and be allowed to slide into and out of the rotor 430 creating vane chambers 442 where fluid may be contained. At an intake 443 of the motor, the vane chambers 442 may increase in volume while being filled with drilling fluid forced in by a pressure at the inlet 443. At a discharge 444 of the motor, the vane chambers 442 decrease in volume, forcing fluid out of the motor.

Figures 1, 5:
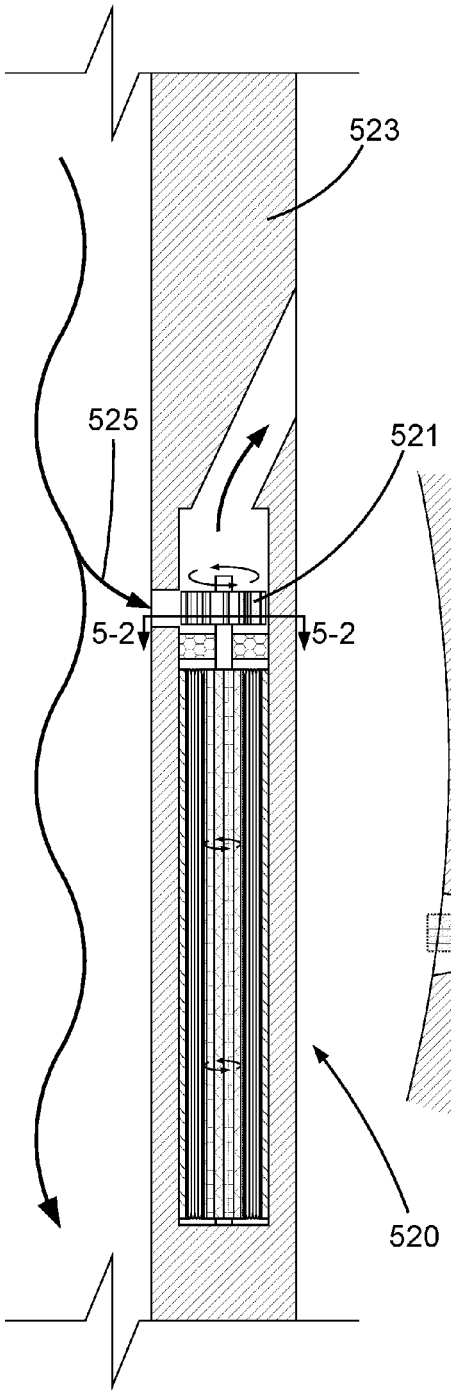
Figures 2, 5:
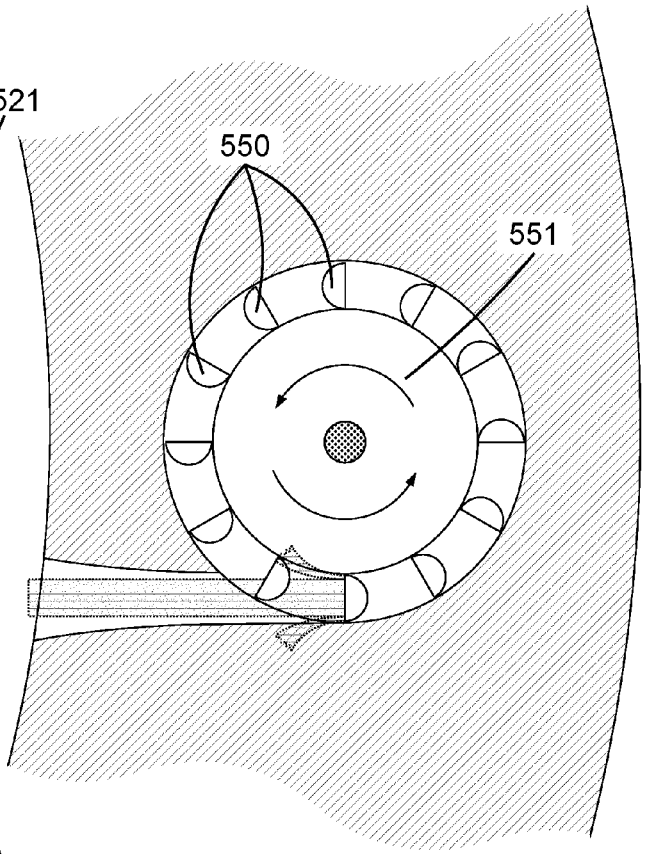

FIG. 5-1 shows an embodiment of a downhole transducer assembly 520 comprising a Pelton wheel 521. The Pelton wheel 521, as also shown in FIG. 5-2, comprises a plurality of cups 550 mounted around an exterior of a wheel 551. A portion of drilling fluid 525 traveling along a drill pipe 523 may impinge upon the cups 550 to rotate the wheel 551. Each of the plurality of cups 550 may comprise a geometry capable of redirecting the portion of drilling fluid 525 back in the direction from whence it came. In this manner, a large percentage of the energy of the impinging drilling fluid 525 may be transferred to the wheel 551.

Figure 6:
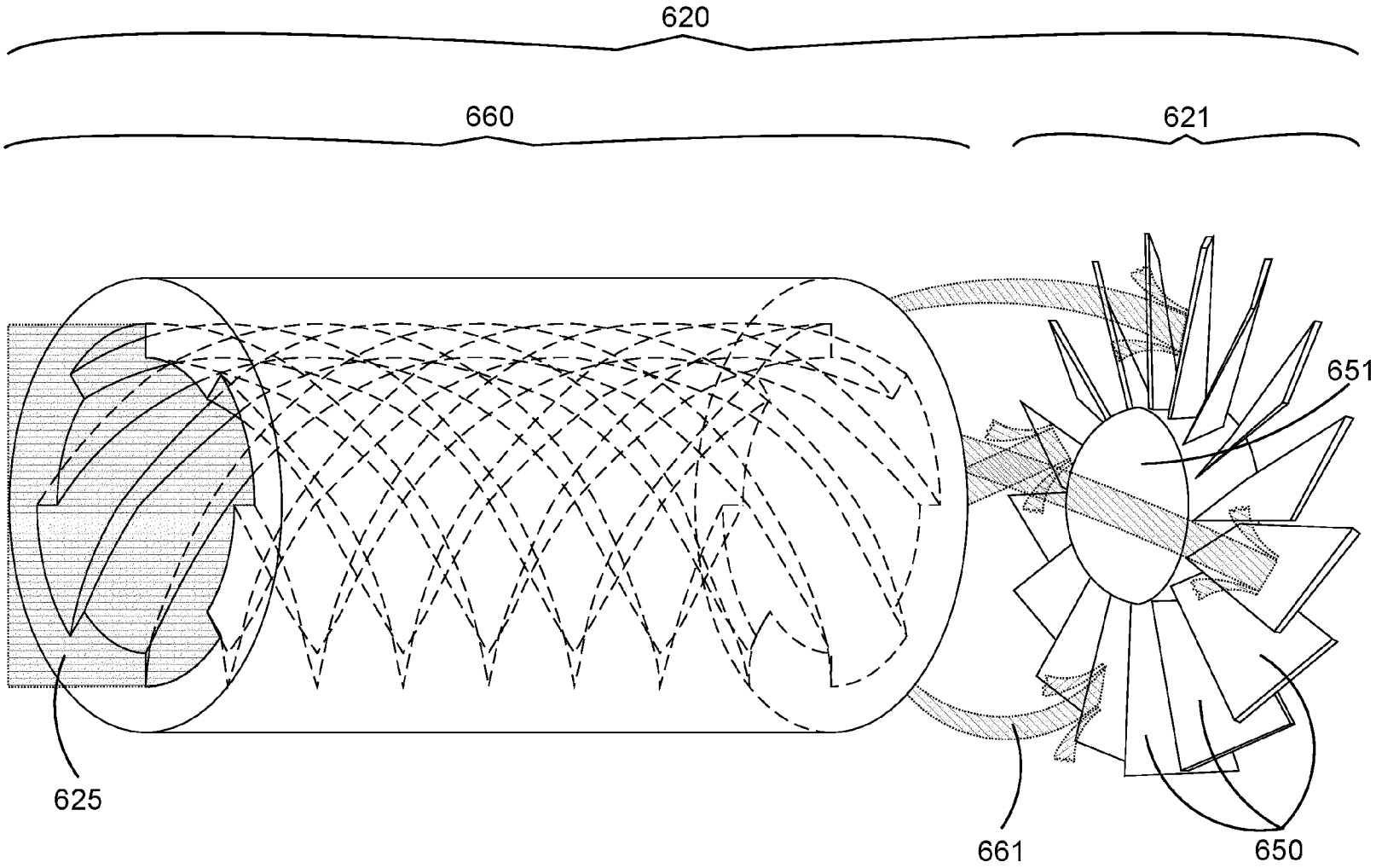
FIG. 6 is a perspective view of a portion of an embodiment of a downhole transducer assembly comprising a turbine and a flow channel.

FIG. 6 shows a portion of an embodiment of a downhole transducer assembly 620 comprising a turbine 621. The turbine 621 may comprises a plurality of blades 650 mounted around an exterior of a drum 651. Drilling fluid 625 may be directed toward the turbine 621 through a flow channel 660 that may generate a helical form 661 in the drilling fluid 625. This helical form 661 may allow the drilling fluid 625 to impinge upon the plurality of blades 650 of the turbine 621 at an angle positioned somewhere between parallel and perpendicular to a rotational axis of the turbine 621. It is believed that impinging upon turbine blades at such an angle may allow for a smaller turbine to be used than previously thought possible.

FIG. 7-1 shows a portion of an embodiment of a downhole transducer assembly comprising a turbine 721-1 connected to a generator 722-1 by a shaft 770-1. A course 726-1 leading to the turbine 721-1 may conduct a portion of drilling fluid traveling through a drill pipe to impact the turbine 721-1 tangentially relative to a rotational axis of the turbine 721-1. The turbine 721-1 may be capable of sliding along the shaft 770-1 relative to the course 726-1 (as shown by the dotted lines). By so doing, the turbine 721-1 may move into and out of contact with drilling fluid passing through the course 726-1. Additionally, the turbine 721-1 may comprise an angled geometry such that the turbine 721-1 may be positioned partially within contact with the drilling fluid to varying degrees. For example, FIG. 7-2 shows an embodiment of a turbine 721-2 comprising a plurality of angled blades 771-2 that may catch a passing fluid to varying degrees based on the turbine's 721-2 position relative thereto.

Referring back to FIG. 7-1, the turbine 721-1 may be slid along the shaft 770-1 by a translatable ramp 772-1 that may be accessed from an exterior of a drill pipe holding the downhole transducer assembly. For instance, FIG. 7-3 shows an embodiment of a drill pipe 723-3 comprising a ramp 772-3 accessible from an exterior wall thereof. The ramp 772-3 may be secured in various physical positions along the drill pipe 723-3. While the present embodiment shows a translatable ramp mechanism to slide a turbine, other adjustment mechanisms would also be suitable.

FIG. 8-1 shows a portion of an embodiment of a downhole transducer assembly comprising a turbine 821-1 connected to a generator 822-1 by a shaft 870-1. The turbine 821-1 may be removable from the shaft 870-1 through an opening 880-1 in a side of the drill pipe holding the downhole transducer assembly. For example, FIG. 8-3 shows an embodiment of a drill pipe 823-3 comprising an opening 880-3 on an exterior thereof. After one turbine is removed 881-3 through the opening 880-3, a replacement turbine 882-3 may be inserted in its stead. To effectuate such a change, an embodiment of a turbine 821-2, as shown in FIG. 8-2, may comprise a slot 883-2 disposed therein that may fit over a shaft.

Whereas the present invention has been described in particular relation to the drawings attached hereto, it should be understood that other and further modifications apart from those shown or suggested herein, may be made within the scope and spirit of the present invention.

The invention claimed is:

1. A downhole transducer assembly, comprising:

a drill pipe capable of passing a fluid flow there through; and a course capable of diverting a portion of the fluid flow to a transducer capable of converting energy from the diverted portion into electrical energy, the transducer including a positive displacement motor attached to a generator, the positive displacement motor including a rotor and a stator, the stator including a nonelastic interior surface; wherein the rotor includes a helically shaped exterior, eccentrically rotatable within the stator, the stator having a helically shaped interior, wherein the helically shaped interior of the stator includes more lobes than the helically shaped exterior of the rotor.

2. The downhole transducer assembly of claim 1, wherein the rotor comprises diamond on an exterior thereof.

3. The downhole transducer assembly of claim 2, wherein the rotor is formed entirely of polycrystalline diamond.

4. The downhole transducer assembly of claim 1, wherein the stator includes diamond on the nonelastic interior surface.

5. The downhole transducer assembly of claim 1, further comprising an outlet capable of discharging the diverted portion of the fluid flow to an exterior of the drill pipe, and wherein the outlet is exposed on an exterior of a lateral sidewall of the drill pipe.

6. The downhole transducer assembly of claim 1, wherein the transducer is disposed within a lateral sidewall of the drill pipe.

7. The downhole transducer assembly of claim 1, wherein the transducer does not obstruct a main fluid flow passing through the drill pipe.

8. The downhole transducer assembly of claim 1, wherein the diverted portion of the fluid flow comprises 1-10 gallons/minute (0.003785-0.03785 $m^3$/min).

9. The downhole transducer assembly of claim 1, wherein the diverted portion of the fluid flow experiences a pressure drop of 500-1000 pounds/square inch (3,447-6,895 kPa) over the transducer.

10. The downhole transducer assembly of claim 1, a material of the helically shaped exterior and the helically shaped interior preventing wear on the helically shaped exterior and the helically shaped interior.

11. A downhole transducer assembly, comprising:

a drill pipe capable of passing a fluid flow there through; and a course capable of diverting a portion of the fluid flow to a transducer capable of converting energy from the diverted portion into electrical energy, the transducer including a turbine attached to a generator, wherein the turbine is adjustable relative to the diverted portion of fluid flow.

12. The downhole transducer assembly of claim 11, wherein blades of the turbine are angled in a direction of adjustability of the turbine relative to the diverted portion of fluid flow.

13. The downhole transducer assembly of claim 11, wherein the turbine is adjustable from the exterior of the drill pipe.

14. The downhole transducer assembly of claim 11, the course diverting the portion of the fluid flow tangentially relative to a rotational axis of the turbine.

15. The downhole transducer assembly of claim 11, the turbine configured to slide along a shaft of the turbine relative to the course.

16. The downhole transducer assembly of claim 15, the turbine configured to move out of a flow path of the portion of the fluid flow.

17. The downhole transducer assembly of claim 15, further comprising a ramp, the ramp configured to slide the turbine along the shaft.

18. The downhole transducer assembly of claim 15, the turbine being positioned at least partially in contact with the portion of the fluid flow based on a position of the turbine with respect to the portion of the fluid flow.

19. A downhole transducer assembly, comprising a drill pipe capable of passing a fluid flow there through; and a course capable of diverting a portion of the fluid flow to a transducer capable of converting energy from the diverted portion into electrical energy, the transducer including a turbine attached to a generator, wherein the turbine is interchangeable.

20. The downhole transducer assembly of claim 19, wherein the transducer comprises a series of turbines attached to a generator.

* * * * *